US011090212B2

(12) United States Patent
Ghosh et al.

(10) Patent No.: US 11,090,212 B2
(45) Date of Patent: Aug. 17, 2021

(54) NEONATAL INCUBATOR SYSTEM WITH IMPROVED ENCLOSURE

(71) Applicant: GE Precision Healthcare LLC, Wauwatosa, WI (US)

(72) Inventors: Anirban Ghosh, Kolkata (IN); R Sreenivasan, Mahadevaura Post (IN); Dipali Prakash Dhokane, Airoli (IN)

(73) Assignee: GE Precision Healthcare LLC, Wauwatosa, WI (US)

( * ) Notice: Subject to any disclaimer, the term of this patent is extended or adjusted under 35 U.S.C. 154(b) by 182 days.

(21) Appl. No.: 16/401,399

(22) Filed: May 2, 2019

(65) Prior Publication Data

US 2020/0345570 A1 Nov. 5, 2020

(51) Int. Cl.
*A61G 11/00* (2006.01)

(52) U.S. Cl.
CPC ..... *A61G 11/006* (2013.01)

(58) Field of Classification Search
CPC .... A61G 11/00; A61G 11/005; A61G 11/006; A61G 11/007
See application file for complete search history.

(56) References Cited

U.S. PATENT DOCUMENTS

| | | | | |
|---|---|---|---|---|
| 5,112,293 | A * | 5/1992 | Vaccaro | A61G 11/00 128/205.26 |
| 6,049,924 | A * | 4/2000 | Prows | A61G 11/00 5/427 |
| 2002/0019578 | A1* | 2/2002 | Honma | A61G 11/00 600/22 |
| 2005/0070756 | A1* | 3/2005 | Falk | A61G 11/005 600/22 |
| 2016/0113415 | A1* | 4/2016 | Albregts | A47F 10/02 62/246 |
| 2017/0202720 | A1* | 7/2017 | Wakabayashi | A61G 11/006 |

* cited by examiner

*Primary Examiner* — John P Lacyk
(74) *Attorney, Agent, or Firm* — Andrus Intellectual Property Law, LLP

(57) ABSTRACT

A neonatal incubator system includes a platform configured to support a neonate and an enclosure supported above the platform and configured to create a chamber around the neonate. The enclosure includes a movable side panel on a side of the enclosure openable to place the neonate on the platform enclosable to secure the neonate within the chamber. The enclosure also includes a latch engageable when the movable side panel is in a closed position and configured to maintain the movable side panel in the closed position, and also includes a biasing device configured to force the movable side panel away from the closed position when the latch is not engaged.

19 Claims, 6 Drawing Sheets

NEONATAL INCUBATOR SYSTEM WITH IMPROVED ENCLOSURE

BACKGROUND

The present disclosure generally relates to neonatal care systems, and more specifically to neonatal care systems having an improved enclosure with a biasing device on a movable side panel.

Some neonates are not physiologically well enough developed to be able to survive without special medical attention. A frequently used medical aid for such infants is the incubator. The primary objective of the incubator is to provide an environment which will maintain the neonate at a minimum metabolic state thereby permitting as rapid physiological development as possible. Neonatal incubators create a microenvironment that is thermally neutral where a neonate can develop. These incubators typically include a humidifier and a heater and associated control system that controls the humidity and temperature in the neonatal microenvironment. The humidifier comprises a device that evaporates an evaporant, such as distilled water, to increase relative humidity of air within the neonatal microenvironment. The humidifier is typically controllable such that the amount of water, or water vapor, added to the microenvironment is adjustable in order to control the humidity to a desired value. The heater may be, for example, an air heater controllable to maintain the microenvironment area to a certain temperature. Radiant warmers may be used instead of incubators for some neonates where less environmental control is required. In still other embodiments, hybrid incubator/radiant warming systems may be utilized, various embodiments of which are well known in the art.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A neonatal incubator system includes a platform configured to support a neonate and an enclosure supported above the platform and configured to create a chamber around the neonate. The enclosure includes a movable side panel on a side of the enclosure openable to place the neonate on the platform enclosable to secure the neonate within the chamber. The enclosure also includes a latch engageable when the movable side panel is in a closed position and configured to maintain the movable side panel in the closed position, and also includes a biasing device configured to force the movable side panel away from the closed position when the latch is not engaged.

Another embodiment of a neonatal incubator system includes a platform configured to support a neonate and an enclosure supported above the platform and configured to create a chamber around the neonate. The enclosure includes a movable side panel openable to place the neonate on the platform enclosable to secure the neonate within the chamber 14. The enclosure further includes a latch that engages when the movable side panel is in a fully closed position and is configured to maintain the movable side panel in the fully closed position. The enclosure further includes a biasing device configured to force the movable side panel from a near-closed position to a fully closed position such that the latch engages.

Various other features, objects, and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

The inventors have recognized a problem with current incubator systems for neonatal care, which is that many incubator systems have side doors that can be propped up in such a way that it seems that the doors are latched when they are not. Having a door to an incubator in an upright, but unlatched position presents a risk that the door will be inadvertently opened and put a neonate at risk. For example, the neonate could fall out of the incubator if the door is accidentally opened, or the neonate may be insufficiently protected from impacts or from outside environmental conditions. While some incubator systems include indicators on latches to indicate when the latch is in a locked position, such indicators are often missed by caregivers who may inadvertently allow a door to remain unlatched while thinking and behaving as if the door is latched and thus securely closed.

Accordingly, the inventors have developed the current system that prevents a side panel, or door, of an incubator enclosure from remaining in a closed or near-closed position without the door being properly latched. The disclosed neonatal incubator system includes a biasing device on a movable side panel of the enclosure. The biasing device is configured to force the movable side panel into one of a fully closed position or into an open position where it will be clear to a caregiver that the door is not latched. In various embodiments, the biasing device may prevent the movable panel from staying in a near-closed, or intermediate position between fully open and fully closed, by making the door heavy at the top, by including a pair of magnets on the door and on the enclosure that attract or repel each other, by having a torsion spring on a hinge or joint of the panel that pushes the door open or closed, or by having a spring-loaded plunger that pushes on the panel. Various examples of biasing devices are disclosed herein. The disclosed system may incorporate one or more biasing devices simultaneously.

Figure 1:
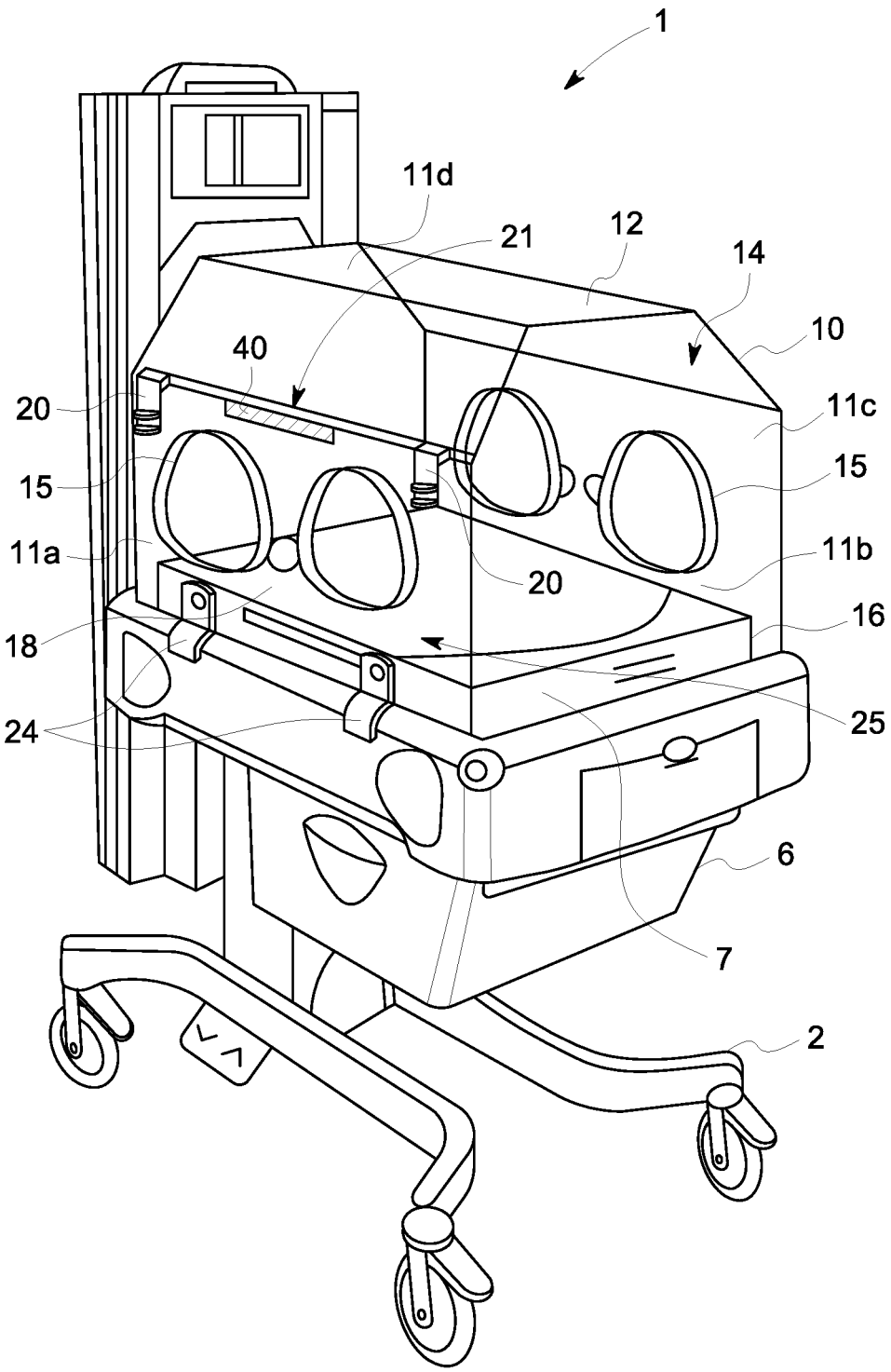
FIG. 1 is a perspective view of an exemplary neonatal incubator system in accordance with one embodiment of the present disclosure.

FIG. 1 depicts one embodiment of an incubator system having an enclosure 10 with a biasing device 40. As will be understood by a person having ordinary skill in the art, the disclosed system and method may be implemented on various types of incubator systems, including incubator/warmer systems and radiant warmer systems having enclosures with movable side panels operable to insert and remove a neonate from a controlled environment enclosable to secure the neonate within an area on the platform 16.

The depicted incubator system 1 includes a base 2 that supports a platform 16 configured for receiving and supporting a neonate. In the depicted embodiment, the base 2 includes a horizontal section comprising a pair of u-shaped horizontal members joined together and providing support for a vertical base member extending upward toward the platform 16. The base 2 may include wheels to provide for ready movement of the incubator system 1. A bassinet platform 16 is supported on the vertical base member, which may be a standard platform for supporting a neonate, such as configured to receive a removable mattress or other sleep surface.

The incubator system 1 includes an enclosure 10 defining a chamber 14 creating a microenvironment for housing a neonate. The enclosure 10 may be, for example, a transparent housing extending above the platform 16. The enclosure 10 creates and defines a chamber 14 providing a microenvironment, which is an area around the neonate where temperature, humidity, and other environmental factors can be controlled.

Figure 2:
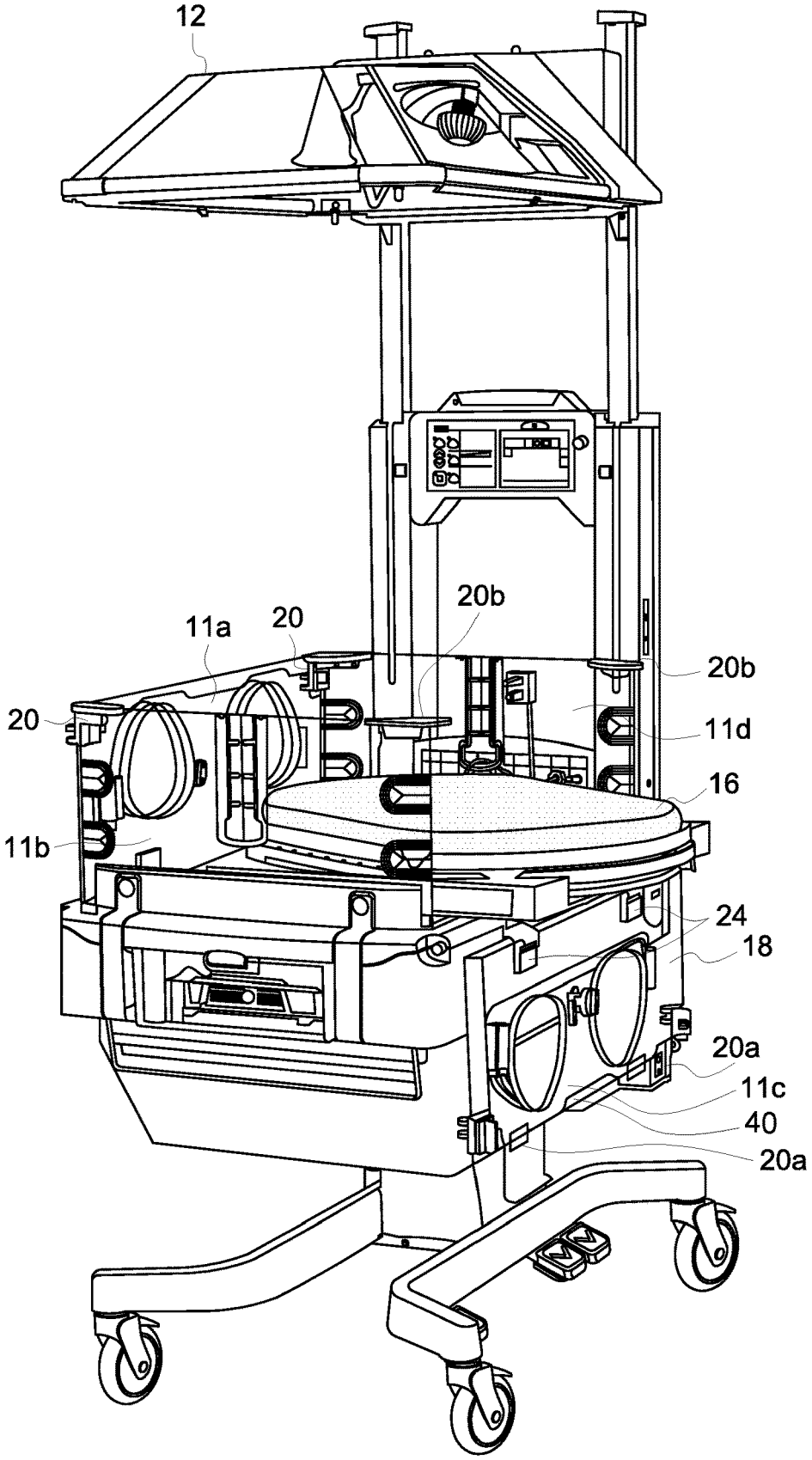
FIG. 2 depicts another embodiment of a neonatal incubator system according to another embodiment of the present disclosure.

The enclosure 10 includes multiple side walls 11*a*-11*d* and a top portion 12. For example, the side walls 11*a*-11*d* and/or the top portion 12 of the enclosure 10 may be made of a transparent plastic material, as is standard in the relevant art. In various embodiments, the top portion 12 may be integrated with the side walls 11*a*-11*d*. In other embodiments, the top portion 12 may be separable from the side walls 11*a*-11*d* of the enclosure 10, as shown in FIG. 2. In the examples, the enclosure 10 includes a plurality of portholes 15 through which a healthcare provider may access the neonate within the chamber 14. The incubator system 1 may further include a heater 7 used to control the temperature within the microenvironment of the chamber 14. For example, the chamber heater 7 may be a radiant heating or warming device that heats the air within the chamber 14 to a predefined temperature or within a predefined temperature range. In another embodiment, the heater 7 may comprise a convective or conductive heating device or any other type of controllable heating or warming device. The incubator system 1 may further include a humidifier system 6 controllable to adjust the relative humidity within with the chamber 14. For example, the humidifier may include a device that evaporates water, such as distilled water, to increase the relative humidity of air within the chamber 14.

The enclosure 10 includes one or more movable side panels 18 on a side wall 11*a*-11*d* of the enclosure 10. The movable side panel 18 is openable to place a neonate on the platform 16 enclosable to secure the neonate within the chamber 14. The movable side panel may be only part of a side wall 11*a*-11*d* of the enclosure 10, or may comprise the entirety of the side wall 11*a*, 11*c* as shown in the depicted embodiments.

Figure 3:
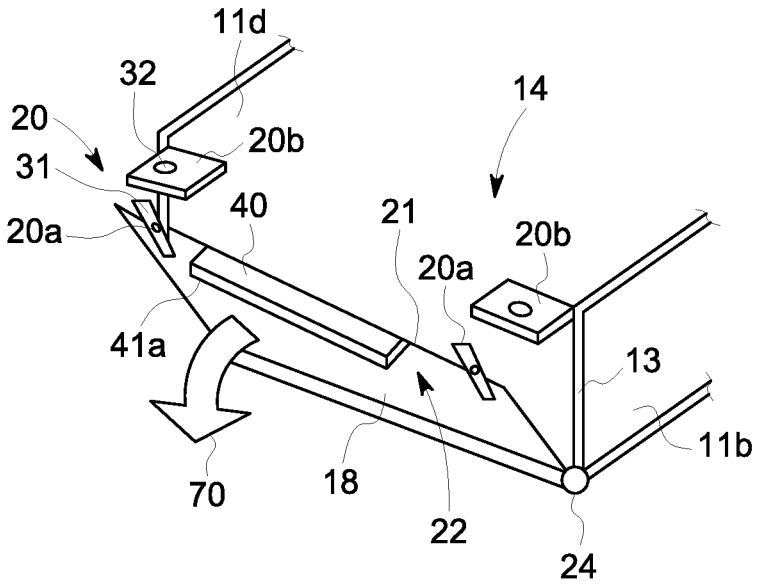
FIG. 3 depicts one exemplary embodiment of a movable side panel with a biasing device for an incubator enclosure according to another embodiment of the present disclosure.
Figure 4:
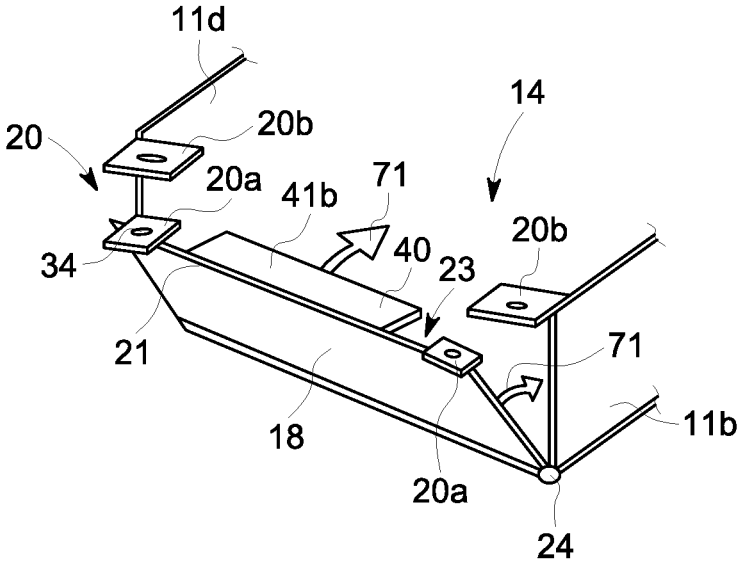
FIG. 4 depicts another embodiment of a movable side panel with a biasing device for an incubator enclosure according to another embodiment of the present disclosure.

In FIG. 1, the movable side panel 18 is shown in a fully-closed position. FIG. 2 shows the movable side panel 18 in a fully open position. FIGS. 3 and 4 show the panel in a near-closed position. In certain embodiments exemplified at FIG. 2, the platform 16 may be configured to slide and/or rotate outward when the movable side panel 18 is open to enable easier access to a neonate and/or to enable easy placement of the neonate on the platform 16. The movable side panel 18 has a top side 21 and a bottom side 25. The movable side panel 18 may attach to the enclosure 10 and/or the platform 16 via one or more hinges 24 allowing the movable side panel 18 to be opened and closed. In other embodiments, the movable side panel may attach to a frame 13 (see FIG. 3) or to a side wall 11*a*-*d* via hinges or other connecting means, such as clips, pins, pressure or frictions fits, etc. In the depicted embodiment, two hinges 24 attach to a lower side 25 of the movable side panel 18 such that the movable side panel 18 rotates downward to open and upward to close. In other embodiments, the movable side panel 18 may rotate clockwise and counter clockwise and one or more hinges 24 may be on a lateral side of the movable side panel 18.

One or more latches are also provided to engage the movable side panel and maintain it in a closed position to secure the neonate within the chamber 14 of the incubator system 1. The latch 20 may be any device or set of devices capable of securing the movable side panel 18 in a close position, including withstanding at least a predefined amount of force that may push against the movable side panel 18, such as by the neonate and/or by elements within the chamber 14 provided as part of the neonatal care (monitors, medical devices, blankets, etc.). Various exemplary latches 20 are disclosed herein, some of which involve two portions, including a panel portion of the latch on the movable side panel and an enclosure portion of the latch connected to the enclosure, where the panel portion 20*a* of the latch and the enclosure portion 20*b* of the latch 20 are reciprocally designed to mate together in order to provide latching.

In various examples, the latch 20 may automatically engage when the movable side panel is in the fully closed position, or may require manual engagement by an operator. The latch 20 may have one or more movable portions that move into engagement, or may mate together via a friction fit. Non-limiting examples of the latch 20 may include a spring-loaded detent, a spring-loaded hook, or other spring-loaded element on one portion of the latch 20*a*, 20*b* that is received by and/or engages the opposing portion of the latch 20*a*, 20*b*. Other embodiments include a hook and eyelet, a clevis fastener, a lever, or other element that engages a recess, hole, protrusion, or other element on the opposing latch portion 20*a*, 20*b*. Various latching devices are known in the relevant art, such as latches 20 on existing incubator/warmer systems. Various latching devices and mechanisms may be appropriate for the embodiments shown herein, and the figures are merely provide examples of latches 20.

As discussed above, the inventors have recognized a problem with existing incubator systems, including incubator/warmer systems, where the door to the incubator can be in a closed but unsecured position where the door appears to be latched but is not. Accordingly, the inventors have developed the disclosed solution that includes a biasing device 40 on the movable side panel 18 configured to force the movable side panel 18 out of a position where it appears latched but is not. Namely, the biasing device 40 prevents the movable side panel 18 from being in a near-closed position or a fully closed position when one or more latches are not engaged. In various examples, the biasing device 40 may be incorporated in the latch 20 or in the hinge 24 associated with a movable side panel 18. In other embodiments, the biasing device 40 may be incorporated elsewhere on the movable side panel 18 and/or on the enclosure 10.

In various examples disclosed herein, the biasing device 40 is configured to force the movable side panel open, away from the closed position when the latch is not engaged. Thereby, the movable side panel 18 automatically opens unless the latch 20 is engaged. In other examples, the biasing device 40 is configured to force the movable side panel 18 into a fully closed position. In certain embodiments, the latch 20 may be configured to automatically engaged when the side panel 18 reaches the fully closed position, and thus the system is designed to force the movable side panel 18 to automatically close and latch, thus avoiding an unsafe situation where the door appears closed but is not latched.

FIGS. 3 and 4 provide examples where the biasing device 40 is a weight 41 configured to exert a torque on the movable side panel 18. In the example of FIG. 3, the weight 41*a* is attached to an outer upper portion 22 (upper half of panel 18 on the outside) and the panel 18 is hinged on the lower portion lower portion 26. Thus, the biasing device 40 is configured to exert a torque on the movable side panel 18 in the direction of arrow 70, and thus biases the movable side panel 18 away from the closed position. Thereby, the movable side panel 18 cannot remain in the closed or near-closed position unless the latch 20 is engaged.

In the depicted example, the latch 20 includes a panel portion 20*a* that is a rotatable lever 31 that engages a hole 32 in the enclosure portion 20*b* of the latch. In various embodiments, the lever 31 may automatically rotate or move to engage the hole 32, such as by a torsion spring. In other embodiments, the lever 31 may be manually rotatable or movable to engage the hole. In the other embodiments, the lever 31 may be provided on the enclosure portion 20*b* of the latch and may rotate to engage the movable side panel 18 or some portion thereon. In the example, the weight 41*a* is positioned on a top side 21 of the movable side panel 18 and is cantilevered outward away from the chamber 14. Thus, the weight 41*a* pulls the movable side panel 18 away from the closed position when the latch 20 is not engaged.

FIG. 4 depicts an embodiment where the biasing device 40 is a weight 41*b* positioned on an inner upper portion 23 (upper half of panel 18 on the inner side toward the chamber 14), and is configured to exert a torque on the movable side panel in the direction of arrow 71 when the movable side panel 18 is in a near-closed position. In the example, the weight 41*b* is positioned on a top side 21 of the movable side panel and is cantilevered inward toward the chamber 14. Thereby, the weight 41*b* biases the movable side panel 18 into the fully closed position when the panel 18 is in a near-closed position.

In the embodiment of FIG. 4, the latch 20 is configured to automatically engage when the movable side panel 18 is in the fully closed position. Thereby, the system 1 is configured such that the movable side panel 18 cannot remain in a closed or near-closed position without the latch automatically engaging to secure the neonate within the chamber 14. In the example, the latch includes a spring-loaded detent 34 on the panel portion 20*a* of the latch, where the enclosure portion 20*b* of the latch is reciprocally designed to receive and engage the spring-loaded detent 34 in order to assume an engaged position. In certain embodiments, the latch 20 may have a release mechanism whereby a caregiver can release the latch in order to open the movable side panel 18. In other embodiments, the latch 20 may be configured such that the spring-loaded detent 34 is overcome and disengages from the enclosure latch portion 20*b* under a predetermined amount of force applied to open the movable side panel 18.

Figure 5:
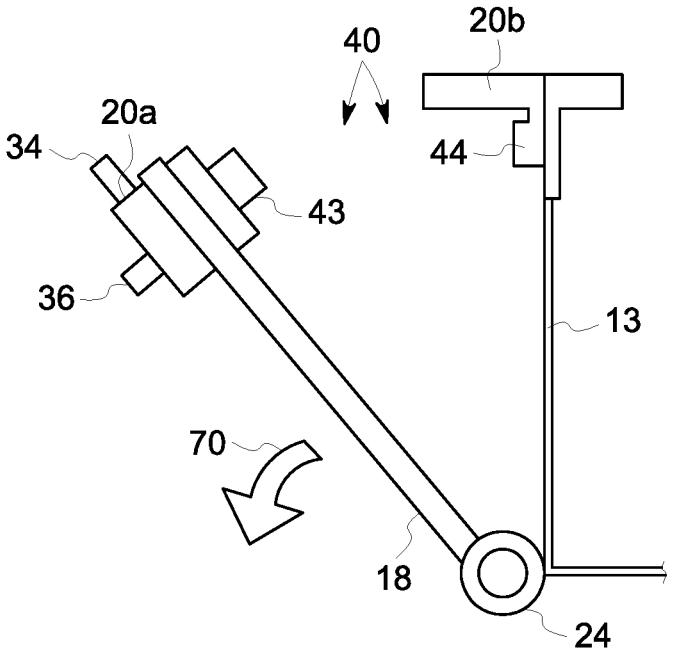
FIG. 5 depicts another embodiment of a movable side panel with a biasing device for an incubator enclosure according to another embodiment of the present disclosure.
Figure 6:
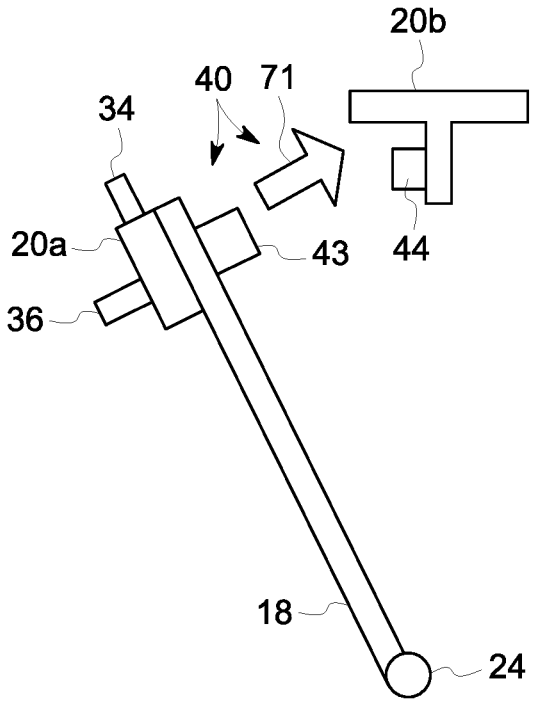
FIG. 6 depicts another embodiment of a movable side panel with a biasing device for an incubator enclosure according to another embodiment of the present disclosure.

FIGS. 5 and 6 depict another embodiment where the biasing device 40 is a set of magnets 43 and 44, including a first magnet 43 connected to the movable side panel 18 and a second magnet 44 connected to the enclosure 10. The magnets 43 and 44 are positioned to align with one another when the movable side panel 18 is in the closed the position. The first magnet 43 may be placed, for example, on the upper portion or top side 21 of the movable side panel. The second magnet 44 is placed at a location on the enclosure 10 that aligns with the first magnet 43 when the side panel 18 is in a closed portion. In certain embodiments where the enclosure has a frame 13 (see FIGS. 3 and 5) the second magnet 44 may be located on the frame 13. In other embodiments, the second magnet may be placed on or adjacent to the enclosure portion 20*b* of the latch 20.

In the embodiment of FIG. 5, the magnets 43 and 44 are oriented such that they repel each other—i.e. with the same poles facing each other. The magnets 43 and 44 are selected and positioned such that they repel each other with sufficient force to push the movable side panel 18 in the direction of arrow 70 such that the movable side panel 18 will not be maintained in the closed position unless the latch is engaged.

FIG. 6 provides an example where the set of magnets 43 and 44 are oriented such that they attract each other, and thus force the movable side panel from a near-closed position into the fully closed position such that the latch 20 automatically engages. Accordingly, the magnets 43 and 44 are selected and placed such that they attract each other with sufficient force to pull the movable side panel 18 into the fully closed position. Thereby, the movable side panel 18 cannot be maintained in an upright position without having the latch engaged. Thus, the above-described problem of non-latching is avoided.

In the depicted examples at FIGS. 5 and 6, the latch 20 includes a spring-loaded detent 34 on the panel portion 20*a* of the latch, which is configured to be depressed as the movable side panel 18 moves toward the closed position, and then engage the enclosure latch portion 20*b* once the movable side panel 18 is in the fully-closed position. The latch includes a release lever 36 that is depressible to overcome the spring force on the detent 34 in order to release the latch 20 and open the movable side panel 18. As described above, various other latching devices and mechanisms may be appropriate for the embodiments shown at FIGS. 5 and 6, and the figures are merely provided one example.

Figure 7:
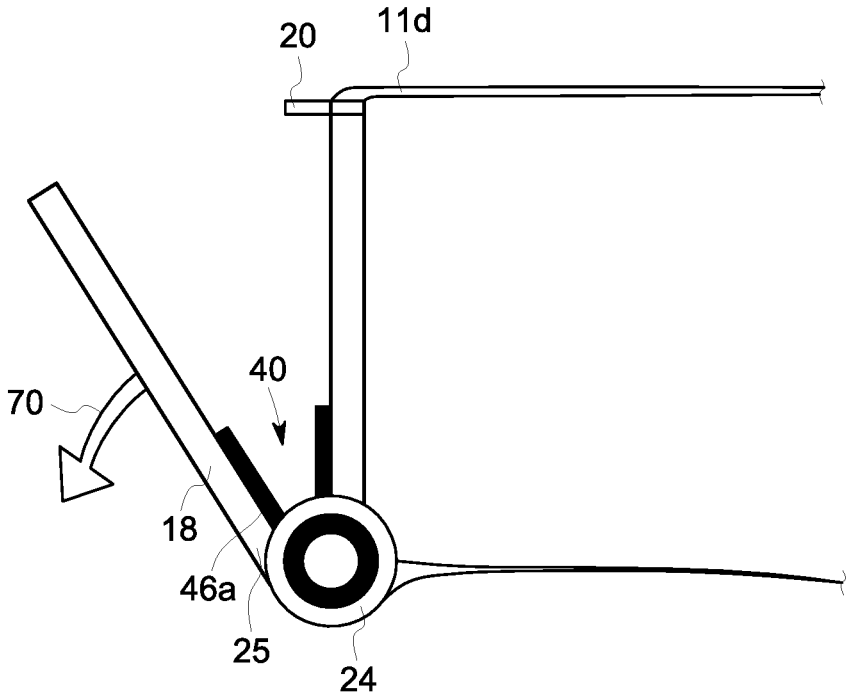
FIG. 7 depicts another embodiment of a movable side panel with a biasing device for an incubator enclosure according to another embodiment of the present disclosure.
Figure 8:
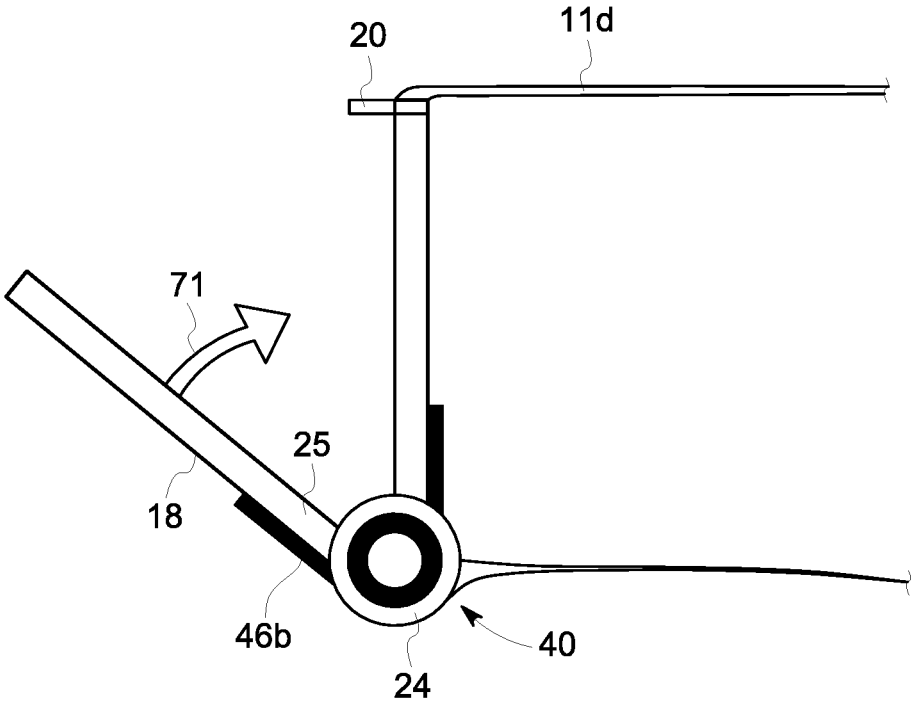
FIG. 8 depicts another embodiment of a movable side panel with a biasing device for an incubator enclosure according to another embodiment of the present disclosure.

FIGS. 7 and 8 depict embodiments where the biasing device 40 is a torsion spring 46. In the embodiments, the torsion spring 46 is integrated in the hinge 24, such as connected on the bottom side 25 of the movable side panel 18. In other embodiments, the torsion spring 46 may be separate from and in addition to the hinge 24. In the embodiment of FIG. 7, the torsion spring 46*a* is configured to exert a torque on the movable side panel in the direction of arrow 70. Thus, the torsion spring 46*a* acts to rotate the movable side panel 18 toward an open position when the movable side panel is in a closed position and the latch 20 is not engaged.

In the example of FIG. 8, the torsion spring 46*b* is configured to exert a torque on the movable side panel 18 in the direction of arrow 71 toward a fully closed position. Thus, when the movable side panel 18 is in a near-closed position, the torsion spring 46*b* will cause the movable side panel 18 to automatically move to the fully closed position. In certain embodiments, the latch 20 is configured to automatically engage when the panel 18 reaches the fully closed position, such that the latch 20 can automatically engage to secure the movable side panel 18 in the closed position and thus secure the neonate in the chamber 14. In such embodiments, the torsion spring 46*b* (or other biasing device 40) is configured to exert enough force to overcome any opposing force caused by the latch 20, such as caused by the spring-loaded detent 34 as the panel moves toward the fully-closed position.

In other embodiments where the biasing device 40 is configured to force to the movable side panel from a near-closed position into a fully closed position, the latch may not automatically engage. Instead, the biasing device 40, may provide enough force to maintain the door the in a fully closed position against at least a predetermined amount of force. This will help maintain the neonate in the chamber and avoid dangerous circumstances, even if the latch 20 is not engaged.

Figure 9A:
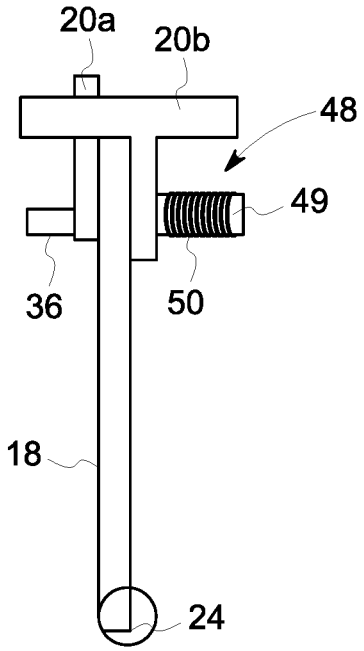
FIG. 9A depicts another embodiment of a movable side panel with a biasing device for incubator an enclosure according to another embodiment of the present disclosure.
Figure 9B:
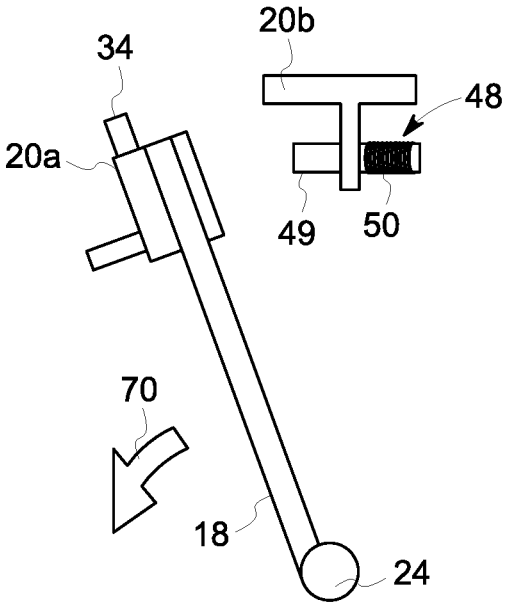
FIG. 9B depicts another embodiment of a movable side panel with a biasing device for incubator an enclosure according to another embodiment of the present disclosure.

FIGS. 9A and 9B depict another embodiment where the biasing device 40 is a spring-loaded plunger 48. The spring-loaded plunger acts to force the movable side panel away from the closed position when the latch 20 is not engaged. In FIG. 9A, the movable side panel 8 is in the fully closed position, and thus the plunger is compressed against the force of the spring 50 and pushed backward toward the chamber 14. When the latch 20 is disengaged, the force of the spring 50 pushes the plunger 49 forward. The plunger 49, in turn, forces the movable side panel 18 to swing in the direction of arrow 70, and thus to move into an open position. Thus, the movable side panel 18 cannot remain in the closed position unless the latch 20 is engaged. In the depicted embodiment, the spring-loaded plunger 48 is positioned on the enclosure 10, and is integrated into the latch 20. In other embodiments, the spring-loaded plunger 48 may be placed elsewhere on the enclosure, such as connected to a frame 13 (see FIG. 3) of the enclosure that supports the side that contacts the movable side panel 18 when in the closed position. In other embodiments, the spring-loaded plunger may be connected to the movable side panel 18. To provide just one example, the spring-loaded plunger 48 may be incorporated into the panel portion 20*a* of the latch 20. Various latching mechanisms may be appropriate for this application, examples of which are described above.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A neonatal incubator system comprising:

a platform configured to support a neonate;

an enclosure supported above the platform and configured to create a chamber around the neonate, the enclosure including:

a movable side panel openable to place the neonate on the platform and closable to secure the neonate within the chamber;

a latch engagable when the movable side panel is in a closed position and configured to maintain the movable side panel in the closed position; and a biasing device configured to exert a biasing force on the movable side panel, wherein the biasing force pushes the movable side panel away from the closed position when the latch is not engaged; and wherein the latch counteracts the biasing force to hold the movable side panel in the closed position when the latch is engaged.

2. The system of claim 1, wherein the biasing device is a weight positioned on the movable side panel configured to exert a torque on the movable side panel that biases the movable side panel away from the closed position.

3. The system of claim 2, further comprising at least one hinge on a bottom side of the movable side panel and connecting the movable side panel to the platform such that the movable side panel rotates downward to open and upward to close, wherein the weight is positioned on an outer upper portion of the movable side panel.

4. The system of claim 3, wherein the latch is on a top side of the movable side panel.

5. The system of claim 1, wherein the biasing device is a set of magnets including a first magnet connected to the movable side panel and a second magnet connected to the enclosure and positioned to align with the first magnet when the movable side panel is in the closed position, wherein the first and second magnets are each oriented such that they repel each other with sufficient force such that the movable side panel will not remain in the closed position unless the latch is engaged.

6. The system of claim 5, wherein the first magnet is on an upper portion of the movable side panel adjacent to a panel portion of the latch on the movable side panel and the second magnet is adjacent to an enclosure portion of the latch connected to the enclosure.

7. The system of claim 1, wherein the biasing device is a spring-loaded plunger including a plunger is compressed against a spring force when the movable side panel is in the closed position such that the plunger pushes the movable side panel toward an open position when the latch is not engaged.

8. The system of claim 7, wherein the spring-loaded plunger is connected to the enclosure.

9. The system of claim 1, wherein the biasing device is a torsion spring positioned at a connection between the movable side panel and the platform that exerts a torque on the movable side panel to rotate the movable side panel toward an open position when the movable side panel is in a closed position and the latch is not engaged.

10. The system of claim 9, further comprising at least one hinge on a bottom side of the movable side panel and connecting the movable side panel to the platform such that the movable side panel rotates downward to open and upward to close, wherein the torsion spring is incorporated in the hinge.

11. A neonatal incubator system comprising:

a platform configured to support a neonate;

an enclosure supported above the platform and configured to create a chamber around the neonate, the enclosure including;

a movable side panel openable to place the neonate on the platform and closable to secure the neonate within the chamber;

a latch that engages when the movable side panel is in a fully closed position and is configured to maintain the movable side panel in the fully closed position;

a biasing device configured to force the movable side panel from a near-closed position into the fully closed position such that the latch engages; and wherein the biasing device includes at least one of a spring configured to exerts biasing force on the movable side panel to rotate the movable side panel toward the fully closed position and at least one magnet configured to pull the movable side panel toward the fully closed position when the movable side panel is in a near-closed position.

12. The system of claim 11, wherein the latch is configured to automatically engage when the movable side panel is in the fully closed position.

13. The system of claim 12, wherein the biasing device further includes a weight positioned on the movable side panel configured to exert a torque on the movable side panel when the movable side panel is in a near-closed position to move the movable side panel to the fully closed position such that the latch will automatically engage.

14. The system of claim 13, further comprising at least one hinge on a bottom side of the movable side panel and connecting the movable side panel to the platform such that the movable side panel rotates downward to open and upward to close, wherein the weight is positioned on an inner upper portion of the movable side panel.

15. The system of claim 11, wherein the at least one magnet includes a set of magnets including a first magnet connected to the movable side panel and a second magnet connected to the enclosure and positioned to align with the first magnet when the movable side panel is in the fully closed position, wherein the first and second magnets are oriented such that they attract each other with sufficient force to pull the movable side panel to the fully closed position when the movable side panel is in a near-closed position.

16. The system of claim 15, wherein the first magnet is on an upper portion of the movable side panel adjacent to a panel portion of the latch on the movable side panel and the second magnet is adjacent to an enclosure portion of the latch.

17. The system of claim 15, wherein the first magnet is on a side portion of the movable side panel and the second magnet is connected to a frame of the enclosure.

18. The system of claim 11, wherein the spring is a torsion spring positioned at a connection between the movable side panel and the platform and the biasing force is a torque exerted on the movable side panel by the torsion spring to rotate the movable side panel toward the fully closed position when the movable side panel is in a near-closed position.

19. The system of claim 18, further comprising at least one hinge on a bottom side of the movable side panel and connecting the movable side panel to the platform such that the movable side panel rotates downward to open and upward to close, wherein the torsion spring is incorporated in the hinge.

* * * * *